US005992954A

United States Patent [19]

Becker

[11] Patent Number: 5,992,954

[45] Date of Patent: Nov. 30, 1999

[54] DISHWASHING MACHINE WITH SUPPORTING STRUCTURE, COMPOSED OF HORIZONTAL AND VERTICAL FRAME MEMBERS, FOR A RINSING CONTAINER

[75] Inventor: Ronald Becker, Breitenbach, Germany

[73] Assignee: Whirlpool Corporation, Benton Harbor, Mich.

[21] Appl. No.: 09/138,447

[22] Filed: Aug. 21, 1998

[30] Foreign Application Priority Data

Aug. 23, 1997 [DE] Germany ..... 197 36 807

[51] Int. Cl.[6] ..... A47B 77/06; B08B 3/02

[52] U.S. Cl. ..... 312/228; 134/58 D

[58] Field of Search ..... 312/228, 228.1, 312/229, 257.1, 311, 276, 265.1, 265.4; 134/58 D, 200, 201

[56] References Cited

U.S. PATENT DOCUMENTS

| | | | |
|---|---|---|---|
| 3,877,765 | 4/1975 | Hassing | 312/265.4 |
| 4,359,250 | 11/1982 | Jenkins | 312/228 |
| 4,746,177 | 5/1988 | Lampman et al. | 312/228 |
| 4,940,298 | 7/1990 | Jackson et al. | 312/228 |
| 5,368,379 | 11/1994 | Wrangberth | 312/228 |
| 5,613,747 | 3/1997 | Becker et al. | 312/228 X |
| 5,860,436 | 1/1999 | Hobday | 134/58 D |

FOREIGN PATENT DOCUMENTS

| | | | |
|---|---|---|---|
| 2015953 | 10/1971 | Germany | 312/228 |
| 4438085 | 5/1996 | Germany . | |
| 2064309 | 6/1981 | United Kingdom | 312/228 |

*Primary Examiner*—Peter M. Cuomo
*Assistant Examiner*—James O. Hansen
*Attorney, Agent, or Firm*—Joel M. Winkle; Thomas A. Schwyn; Robert O. Rice

[57] ABSTRACT

A dishwashing machine with a supporting structure is provided and is constructed from horizontal and vertical frame members. The supporting structure forms at least a front and a rear supporting frame which support a rinsing container. The parts and assembly costs for the dishwashing machine can be considerably reduced in that the supporting frames are assembled from individual horizontal frame members and vertical frame members, the respectively abutting areas of a horizontal and a vertical frame member being provided with locking and counter-locking elements which are adapted to one another. The rinsing container is provided with integral grooves for the positive positioning of the supporting structure on the rinsing container.

9 Claims, 2 Drawing Sheets

DISHWASHING MACHINE WITH SUPPORTING STRUCTURE, COMPOSED OF HORIZONTAL AND VERTICAL FRAME MEMBERS, FOR A RINSING CONTAINER

BACKGROUND OF THE INVENTION

1. Field of the Invention

The invention relates to a dishwashing machine with a supporting structure which is constructed from horizontal and vertical frame members, said structure forming at least a front and a rear supporting frame, also forming a receiving means into which the rinsing container is installed.

2. Description of the Related Art

A dishwashing machine of this type is known from DE 44 38 085 C2. The supporting structure consists of two U-shaped supporting frames, which are bent from a U-profile section. The U-profile section is made of metal, it being necessary for punching out and force fitting at the transitions from the horizontal to the vertical members to be undertaken, in order to obtain adequate stability of the supporting frame. The rinsing container is installed in the ready-made supporting construction and connected securely to the latter. The rinsing container can thereby be connected to the supporting structure by force fitting or screwing down.

This known supporting structure requires fairly expensive components which also makes the assembly for the mounting of the supporting structure and its connection to the rinsing container costly.

SUMMARY OF THE INVENTION

It is the object of the invention to create a supporting structure for a dishwashing machine of the type mentioned at the beginning, in which the parts can be produced easily and cheaply, can be assembled with minimal difficulty and can be connected to the rinsing container.

This object is achieved according to the invention in that the supporting frames are assembled from individual horizontal frame members and vertical frame members, the respectively abutting areas of a horizontal and a vertical frame member being provided with locking and counterlocking elements which are adapted to one another and in that the rinsing container is provided with integral receiving means for the positive positioning of the supporting structure on the rinsing container.

The frame members can be assembled simply by inserting and locking together to the supporting structure, the connection between the rinsing container and the supporting structure being similarly created also by the positive engagement of the supporting structure into the receiving means of the rinsing container. The locking connections for the supporting structure and the force fit between the supporting structure and the rinsing container considerably facilitate the assembly and remove the need for costly screw connections and force fitting for fixing the rinsing container in the supporting structure. In addition the supporting structure and the rinsing container can be dismantled without damage and can be utilised again.

The positive locking between the rinsing container and the supporting structure is achieved according to a development by the fact that the frame members of the supporting structure are designed essentially as open U-profiles towards the exterior side and the receiving means of the rinsing container are designed as correspondingly wide grooves opening outwards.

According to one development, the horizontal frame members can be locked to the vertical frame members in a uniform insertion direction from above to below, then especially the locking connection of the lower horizontal frame members to the vertical frame members is held in a locked position by the pressure applied by the rinsing container. The rinsing container can be installed into the partly assembled supporting frame which is still open upwards and finally be fixed in the supporting structure with the upper horizontal frame members.

For simple locking connections there are locking elements which are designed as locking tongues with a locking projection and there are counterlocking elements which are designed as parallel aligned locking tongues with locking receiving means for the locking projections, and the horizontal frame members can be installed by means of brackets in slots of the vertical frame members. If the brackets of the horizontal frame members are introduced into the slots of the vertical frame members and adjusted downwards, then in the end position the locking projections of the locking tongues of the horizontal frame members lock into the locking receiving means of the locking tongues of the vertical frame members.

The design of the locking elements on the horizontal frame members is according to one development of such a type that the ends of the horizontal frame members are closed off with closing walls in which the locking tongues are divided by means of U-shaped slots, that the locking projections and the brackets project on the closing walls while the counterlocking elements are formed on the vertical frame members by virtue of the fact that the locking tongues of the counterlocking elements are divided by slots in the base member of the vertical frame members and that the slots receive the brackets of the horizontal members.

The frame members for the supporting structure are designed as plastic profiles and can be produced at a reasonable price as plastic injection moulded parts which can be stiffened by means of ribs to achieve adequate stability of the supporting structure. In addition, the supporting structure can be recycled which is ecologically beneficial in case any wastage occurs during production.

In a further development, the lower horizontal frame members broaden out at their ends as supports for enlarging the connecting surface so that the rinsing container is better supported above the lower frame member.

According to a further development, the lower ends of the vertical frame members of the front supporting structure broaden out and are formed as feet, then these feet can also be designed as a receiving means for the height adjusting device.

A further simplification in the assembly of the dishwashing machine is achieved in that the frame members are provided with additional locking and/or counterlocking elements for components and sub-assemblies which are provided with counterlocking and/or locking elements, such as an operating plate, side walls, base plinths, rear wall, base sump and similar.

The invention is described in greater detail with reference to an embodiment, given by way of example, which is shown in the drawings which show:

DESCRIPTION OF THE PREFERRED EMBODIMENT

Figure 1:
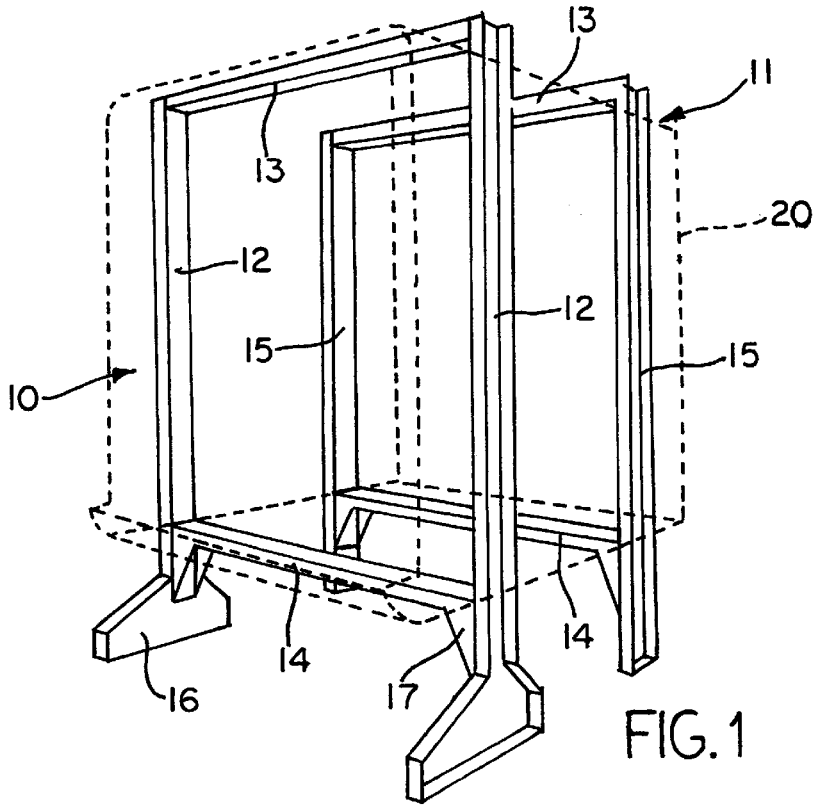
FIG. 1 in perspective view, a supporting structure comprising a front and a rear supporting frame for a rinsing container of a dishwashing machine, FIG. 2 in front view, the front side of a horizontal frame member with the locking element and the upper end of a vertical frame member facing towards said horizontal member with the counterlocking element, FIG. 3 the side view belonging to FIG. 2 of both frame members and FIG. 4 in perspective view, the assembled unit of supporting structure and rinsing container.

As FIG. 1 shows the supporting structure for the rinsing container 20 comprises a front supporting frame 10 and a rear supporting frame 11. The front supporting frame 10 is composed of two identical, vertical frame members 12, an upper horizontal frame member 13 and a lower horizontal frame member 14. The ends of the lower frame member 14 are widened out as supports 17 in order to obtain a larger connecting surface and hence a better support for the rinsing container 20 resting thereon. The vertical frame members 12 broaden out below as feet 16 which can also be designed as receiving means for the height adjusting device. The lower supporting frame 11 uses identical horizontal members 13 and 14 but has simpler vertical frame members 15 without feet 16. The supporting frames 10 and 11 form a receiving means, into which a cuboid rinsing container 20 may be introduced.

The assembly of the supporting frames 10 and 11 results via locking connections with locking and counterlocking elements which are already installed on the frame members. For this reason, the frame members are produced preferably as a plastic profile in a plastic injection moulding process. These plastic profiles are essentially U-profiles which, as can be seen from the example of a vertical frame member 12 in FIG. 2, are stiffened by means of ribs 12.4 between the side members 12.2 and 12.3 to obtain adequate stability.

Figure 2:
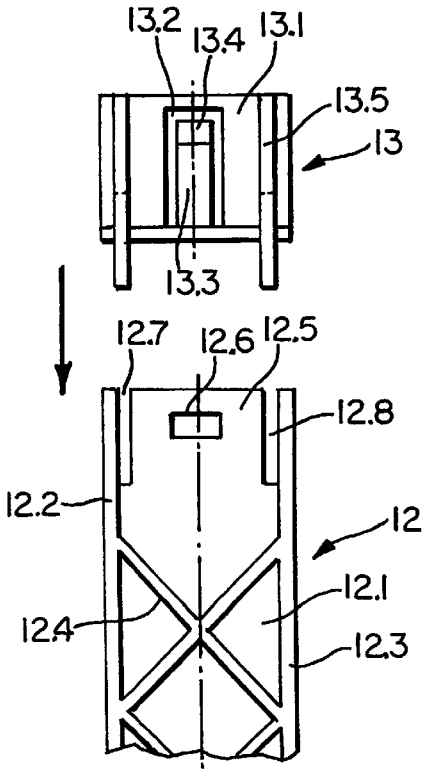
Figure 3:
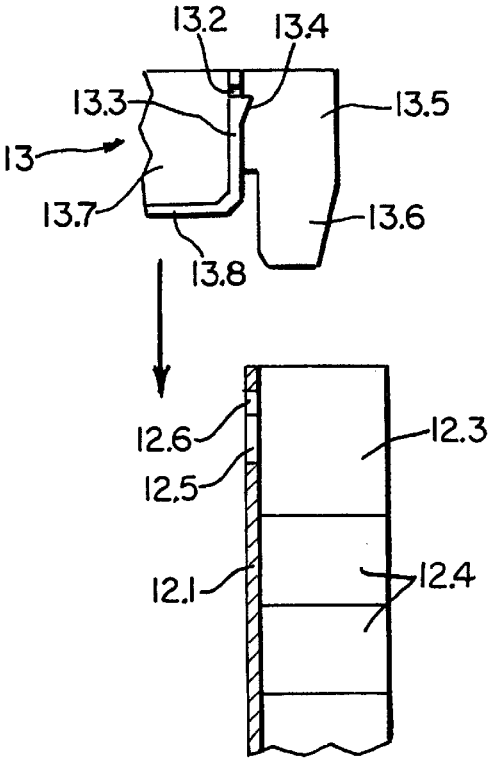

As the views according to FIGS. 2 and 3 show, the horizontal ends of the base 13.8 and the side walls 13.7 of the horizontal, U-shaped frame members 13 are closed off with a closing wall 13.1 in which a locking tongue 13.3 is divided by means of a U-shaped slot 13.2. A locking projection 13.4, which projects on the closing wall 13.1, is formed on the locking tongue 13.3. On both sides of the locking tongue 13.3, brackets 13.5 are formed which stand out from the closing wall 13.1. The upper end of the vertical frame member 12 has two slots 12.7 and 12.8 into which the brackets 13.5 can be secured with the bracket ends 13.6. Both slots 12.7 and 12.8 divide likewise a locking tongue 12.5 which bears a locking receiving means 12.6 for the locking projection 13.4 of the locking tongue 13.3. The horizontal frame member 13 is displaced with the brackets 13.5 in the slots 12.7 and 12.8 so far downwards till the bracket ends 13.6 with the shoulder strike against the end of the brackets 12.7 and 12.8. Then the locking projection 13.4 locks in behind the locking receiving means 12.6 and fixes the horizontal frame member 13 to the vertical frame member 12. By deflecting the locking tongues 12.5 and 13.3, this locking connection can also be released again for dismantling the supporting structure.

In order to connect the lower frame member 14 to the vertical frame members 12 or 15 the slots 12.7 and 12.8 are longer so that the brackets 13.5 can be installed. In addition, they are connected together at one end via a transverse slot if a locking tongue with a locking receiving means 12.6 is also desired in this area. However this is not definitely required if the locking tongue 13.3 is deflectable on the horizontal frame member 13 or 14.

Figure 4:
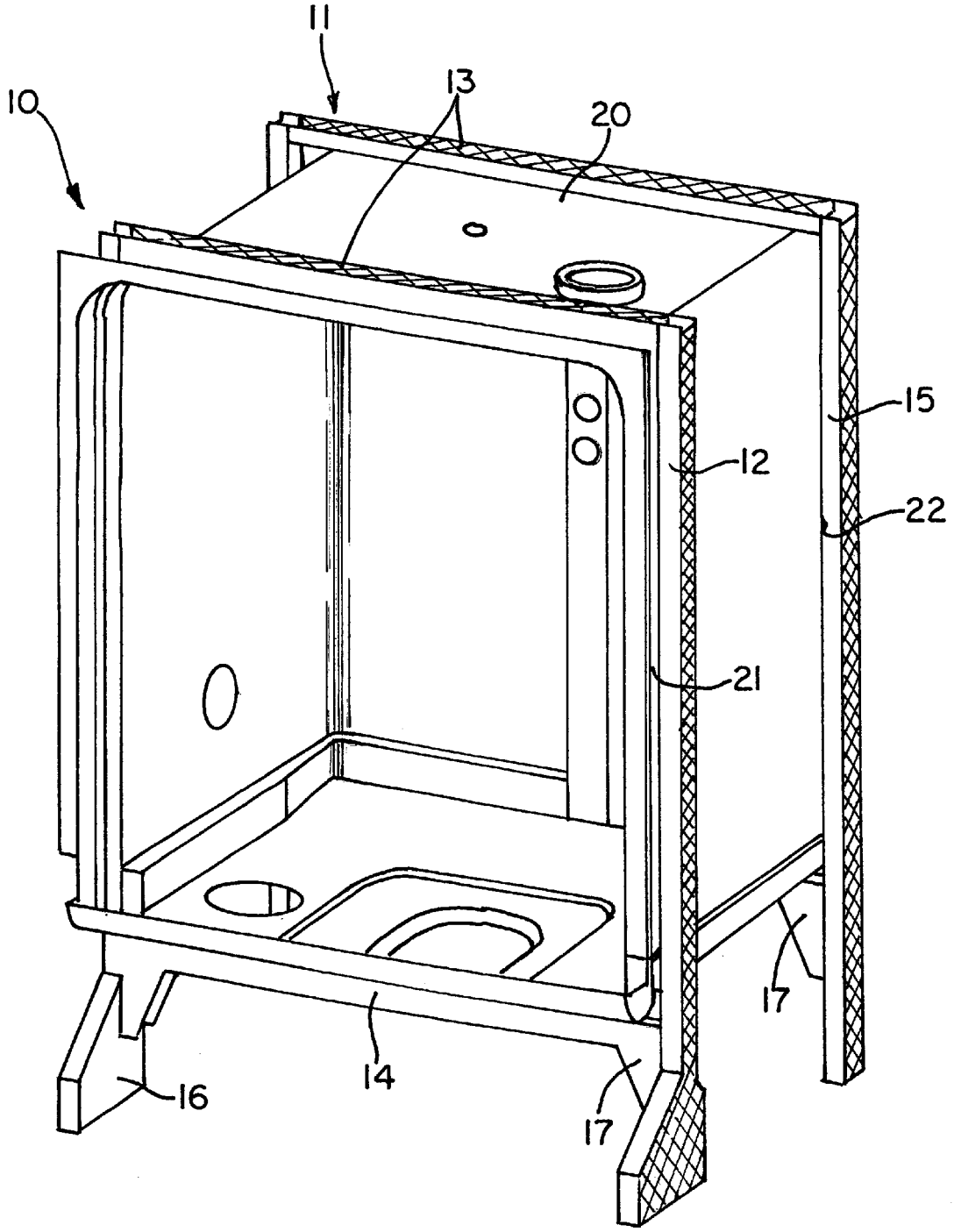

The U-shaped frame members are open towards the exterior side of the supporting frames 10 and 11. As FIG. 4 shows, a cuboid rinsing container 20 can have integral vertically extending grooves 21 and 22, which are designed as receiving means for the vertical frame members 12 and 15, on its vertical exterior walls. If the supporting frames 10 and 11 are still open upwards, then the rinsing container 20 can be installed positively in both supporting frame parts, till said rinsing container sits on the lower horizontal frame members 14. The supporting frame parts engage into the grooves 21 and 22 of the rinsing container 20 and are positioned with them. Then only the upper horizontal frame members 13 need to be clipped onto the parts of the supporting frame to complete the supporting frames 10 and 11 and to fix the rinsing container 20 in the supporting structure.

It is easy to understand that additional locking and/or counterlocking elements of another development can also be formed on the frame members 12 to 15 on any point with which elements other components and sub-assemblies can be installed in the supporting structure such as an operating plate, side walls, base plinths, base sump and similar. This facilitates the assembly of the dishwashing machine even more.

I claim:

1. A dishwashing container assembly, comprising:

a rinsing container;

a supporting structure which is constructed from a plurality of horizontal frame members and a plurality of vertical frame members for forming at least a front supporting frame and a rear supporting frame which support the rinsing container;

the front supporting frame and the rear supporting frame are assembled from individual horizontal frame members and vertical frame members, the horizontal and vertical frame members having abutting areas when assembled into the front support frame and the rear support frame, the abutting areas of the horizontal and vertical frame members having locking tongues with a locking projection and corresponding counterlocking elements having receiving openings for receiving the locking projections, the horizontal frame members further having brackets and the vertical frame members further having slots such that the horizontal frame members can be installed by means of the brackets in the slots of the vertical frame members, such that the horizontal frame members can be locked to the vertical frame members in a uniform insertion direction from above to below, and the rinsing container is provided with integral receiving means for the positive positioning of the front supporting frame and the rear supporting frame on the rinsing container.

2. The dishwashing container assembly according to claim 1, wherein the vertical and horizontal frame members of the supporting structure are designed essentially as open U-profiles and the receiving means of the rinsing container are designed as correspondingly wide grooves opening outwards.

3. The dishwashing container assembly according to claim 1, wherein the vertical and horizontal frame members are elongated members having ends, the ends of the horizontal frame members arc closed off with closing walls in which the locking tongues are divided by means of U-shaped slots and in that the locking projections and the brackets project on the closing walls.

4. The dishwashing container assembly according to claim 1, wherein the the vertical frame members include the counterlocking elements having locking tongues which are divided by the slots of the vertical frame members wherein the slots receive the brackets of the horizontal members.

5. The dishwashing container assembly according to claim 1, wherein the vertical and horizontal frame members of the supporting structure are designed as plastic profiles which can be stiffened by means of ribs.

6. The dishwashing container assembly according to claim 1, wherein the front and rear supporting frames both include a lower horizontal frame member and an upper horizontal frame member the lower horizontal frame member is an elongated member having a middle portion and opposite ends the opposite ends being broadened out as supports.

7. The dishwashing container assembly according to claim 1, wherein the vertical frame members of the front supporting frame having lower ends which broaden out and are formed as feet.

8. The dishwashing container assembly according to claim 1, further wherein the front supporting frame and the rear supporting frame can be readily are assembled together without the use of fasteners, adhesives or secondary assembly processing such as welding.

9. A dishwashing container assembly, comprising:

a rinsing container having side walls, a top wall and a bottom wall;

a front supporting frame having two horizontal frame members and two vertical frame members, the frame members assembling together such that the vertical frame members are positioned along the side walls of the rinsing container and the horizontal frame members are positioned along the top and bottom wall of the rinsing container, respectively;

a rear supporting frame having two elongated horizontal frame members and two elongated vertical frame members, each of the elongated horizontal frame members having opposite ends, each of the opposite ends having a bracket and a locking tongue with a locking projection, each of the elongated vertical frame members having a slot and a receiving opening such that the frame members are assembled together by inserting the bracket into the slot wherein the locking projection is received into the receiving opening, the frame members assembling together such that the vertical frame members are positioned along the side walls of the rinsing container and the horizontal frame members are positioned along the top and bottom wall of the rinsing container, respectively;

wherein the front supporting frame and the rear supporting frame support the rinsing container and can be readily are assembled together without the use of fasteners, adhesives or secondary assembly processing such as welding, and wherein the rinsing container is provided with integral receiving means for the positive positioning of the front supporting frame and the rear supporting frame on the rinsing container.

* * * * *